US006494323B1

(12) United States Patent
Chalmers

(10) Patent No.: US 6,494,323 B1
(45) Date of Patent: Dec. 17, 2002

(54) CARRYING CASE ASSEMBLY FOR MAGNET-ATTRACTING OBJECTS

(76) Inventor: Brenda J. Chalmers, 8285 Hartwell St., Detroit, MI (US) 48228

( * ) Notice: Subject to any disclaimer, the term of this patent is extended or adjusted under 35 U.S.C. 154(b) by 95 days.

(21) Appl. No.: 09/844,765

(22) Filed: Apr. 27, 2001

(51) Int. Cl.[7] ..... A45C 11/26

(52) U.S. Cl. ..... 206/350; 206/534; 206/570; 206/370

(58) Field of Search ..... 206/350, 443, 206/473, 810, 818, 370

(56) References Cited

U.S. PATENT DOCUMENTS

| | | | | | |
|---|---|---|---|---|---|
| 402,550 | A | * | 4/1889 | Willbrandt | 206/234 |
| 2,455,506 | A | * | 12/1948 | Leslie | 206/818 |
| 2,648,366 | A | * | 8/1953 | Higbee et al. | 190/108 |
| 2,713,937 | A | | 7/1955 | Schneider | |
| D197,145 | S | | 12/1963 | Packet | |
| 3,335,847 | A | | 8/1967 | Murphy et al. | |
| 3,727,658 | A | | 4/1973 | Eldridge, Jr. | |
| 3,944,069 | A | | 3/1976 | Eldridge, Jr. | |
| 4,013,109 | A | * | 3/1977 | Sandel | 206/350 |
| 4,664,302 | A | | 5/1987 | Dalbo et al. | |
| 5,489,021 | A | * | 2/1996 | Wallingford | 206/214 |
| 5,538,132 | A | * | 7/1996 | Propp et al. | 206/350 |

* cited by examiner

*Primary Examiner*—Mickey Yu
*Assistant Examiner*—Troy Arnold

(57) ABSTRACT

A carrying case assembly for magnet-attracting objects for safely storing and carrying sharp objects such as pins and needles. The carrying case assembly for magnet-attracting objects includes a carrying case including a spine and pieces of semi-rigid material with the spine being centrally-disposed between the pieces of semi-rigid material; and also includes a magnet being disposed between the pieces of semi-rigid material; and further includes a pocket being disposed upon one of the pieces of semi-rigid material; and also includes a cushion being disposed upon one of the pieces of semi-rigid material; and further includes a fastening member being attached to the pieces of semi-rigid material for closing the carrying case.

9 Claims, 2 Drawing Sheets

CARRYING CASE ASSEMBLY FOR MAGNET-ATTRACTING OBJECTS

BACKGROUND OF THE INVENTION

1. Field of the Invention

The present invention relates to a carrying case and more particularly pertains to a new carrying case assembly for magnet-attracting objects for safely storing and carrying sharp objects such as pins and needles.

2. Description of the Prior Art

The use of a carrying case is known in the prior art. More specifically, a carrying case heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,944,069; U.S. Pat. No. 4,664,302; U.S. Pat. No. 3,335,847; U.S. Pat. No. 2,713,937; U.S. Pat. No. Des. 197,145; and U.S. Pat. No. 3,727,658.

While these devices fulfill their respective, particular objectives and requirements, the aforementioned patents do not disclose a new carrying case assembly for magnet-attracting objects. The inventive device includes a carrying case including a spine and pieces of semi-rigid material with the spine being centrally-disposed between the pieces of semi-rigid material; and also includes a magnet being disposed between the pieces of semi-rigid material; and further includes a pocket being disposed upon one of the pieces of semi-rigid material; and also includes a cushion being disposed upon one of the pieces of semi-rigid material; and further includes a fastening member being attached to the pieces of semi-rigid material foreclosing the carrying case.

In these respects, the carrying case assembly for magnet-attracting objects according to the present invention substantially departs from the conventional concepts and designs of the prior art, and in so doing provides an apparatus primarily developed for the purpose of safely -storing and carrying sharp objects such as pins and needles.

SUMMARY OF THE INVENTION

In view of the foregoing disadvantages inherent in the known types of carrying case now present in the prior art, the present invention provides a new carrying case assembly for magnet-attracting objects construction wherein the same can be utilized for safely storing and carrying sharp objects such as pins and needles.

The general purpose of the present invention, which will be described subsequently in greater detail, is to provide a new carrying case assembly for magnet-attracting objects which has many of the advantages of the carrying case mentioned heretofore and many novel features that result in a new carrying case assembly for magnet-attracting objects which is not anticipated, rendered obvious suggested, or even implied by any of the prior art carrying case, either alone or in any combination thereof.

To attain this, the present invention generally comprises a carrying case including a spine and pieces of semi-rigid material with the spine being centrally-disposed between the pieces of semi-rigid material; and also includes a magnet being disposed between the pieces of semi-rigid material; and further includes a pocket being disposed upon one of the pieces of semi-rigid material; and also includes a cushion being disposed upon one of the pieces of semi-rigid material; and further includes a fastening member being attached to the pieces of semi-rigid material for closing the carrying case.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carrying case assembly for magnet-attracting objects which has many of the advantages of the carrying case mentioned heretofore and many novel features that result in a new carrying case assembly for magnet-attracting objects which is not anticipated, rendered obvious, suggested, or even implied by any of the prior art carrying case, either alone or in any combination thereof.

It is another object of the present invention to provide a new carrying case assembly for magnet-attracting objects which may be easily and efficiently manufactured and marketed.

It is a further object of the present invention to provide a new carrying case assembly for magnet-attracting objects which is of a durable and reliable construction.

An even further object of the present invention is to provide a new carrying case assembly for magnet-attracting objects which is susceptible of a low cost of manufacture with regard to both materials and labor, and which accordingly is then susceptible of low prices of sale to the consuming public, thereby making such carrying case assembly for magnet-attracting objects economically available to the buying public.

Still yet another object of the present invention is to provide a new carrying case assembly for magnet-attracting objects which provides in the apparatuses and methods of the prior art some of the advantages thereof, while simultaneously overcoming some of the disadvantages normally associated therewith.

Still another object of the present invention is to provide a new carrying case assembly for magnet-attracting objects for safely storing and carrying sharp objects such as pins and needles.

Yet another object of the present.invention is to provide a new carrying case assembly for magnet-attracting objects which includes a carrying case including a spine and pieces of semi-rigid material with the spine being centrally-disposed between the pieces of semi-rigid material; and also includes a magnet being disposed between the pieces of semi-rigid material; and further includes a pocket being disposed upon one of the pieces of semi-rigid material; and also includes a cushion being disposed upon one of the pieces of semi-rigid material; and further includes a fastening member being attached to the pieces of semi-rigid material for closing the carrying case.

Still yet another object of the present invention is to provide a new carrying case assembly for magnet-attracting objects that is easy and convenient to use and store pins and needles.

Even still another object of the present invention is to provide a new carrying case assembly for magnet-attracting objects that prevents a user from being pricked or cut with pins and needles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
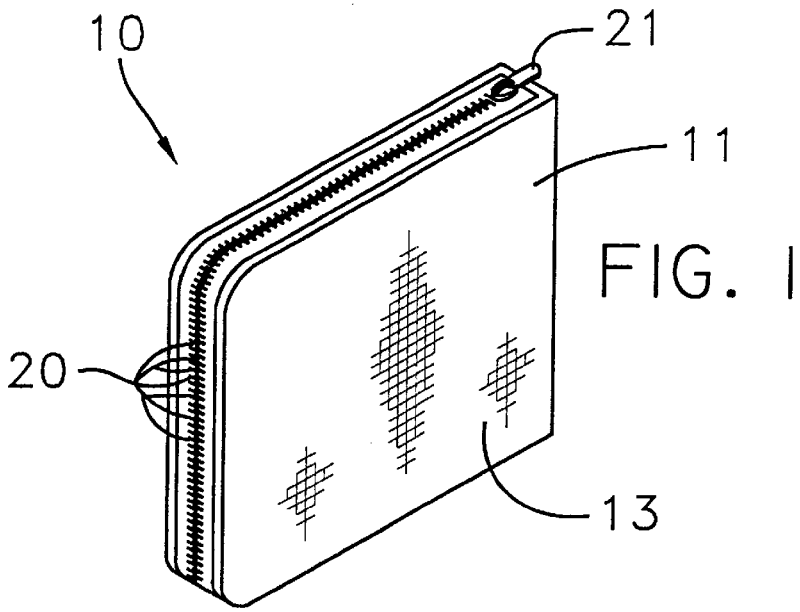
FIG. 1 is a perspective view of a new carrying case assembly for magnet-attracting objects according to the present invention.
Figure 2:
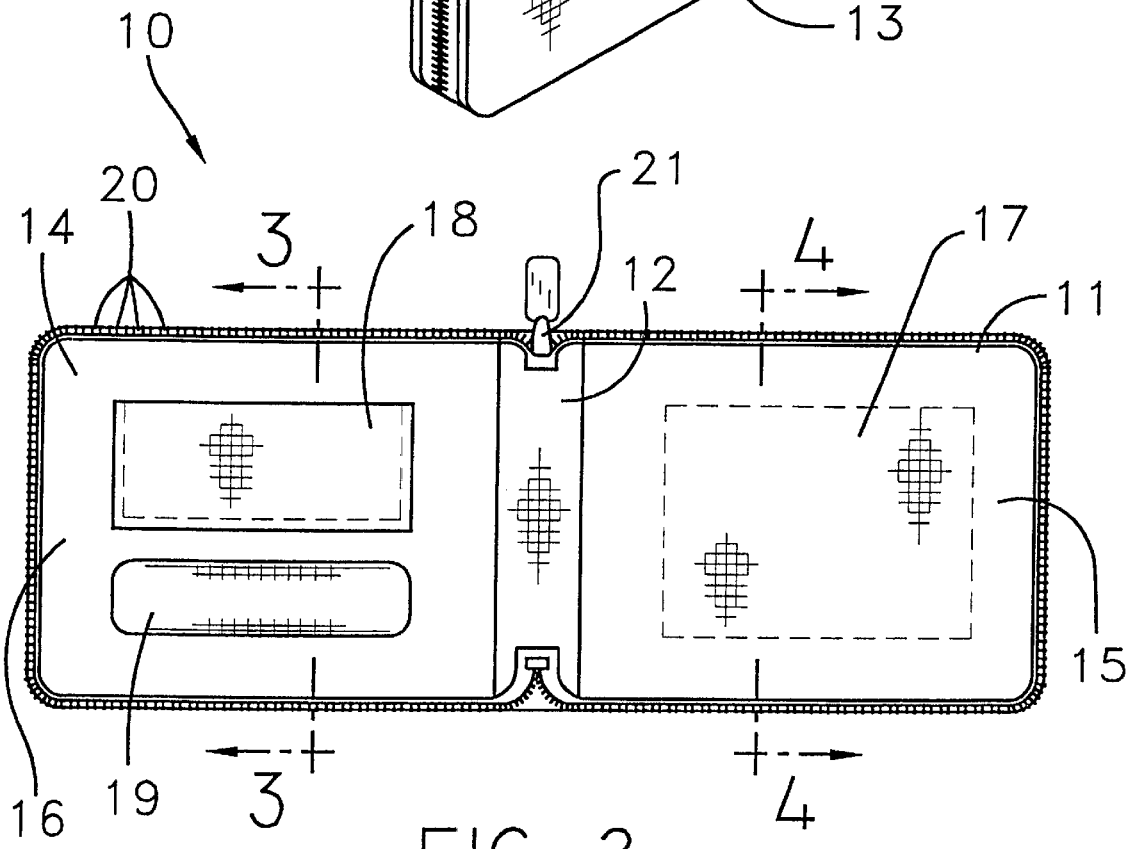
FIG. 2 is a side elevational view of the present invention.
Figure 3:
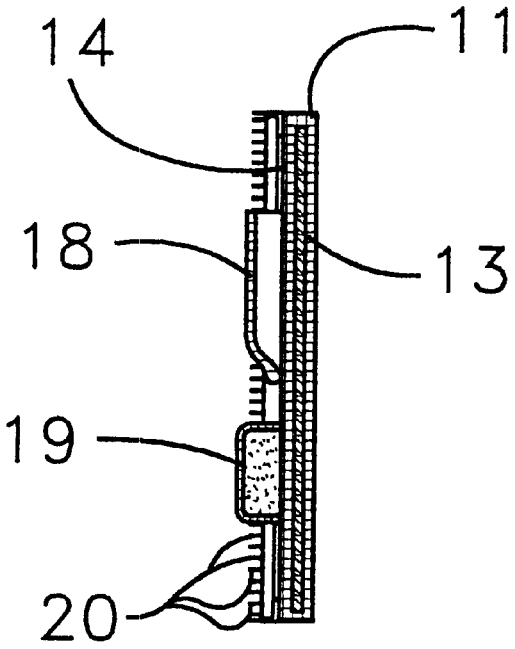
FIG. 3 is an on-edge elevational view of the present invention.
Figure 4:
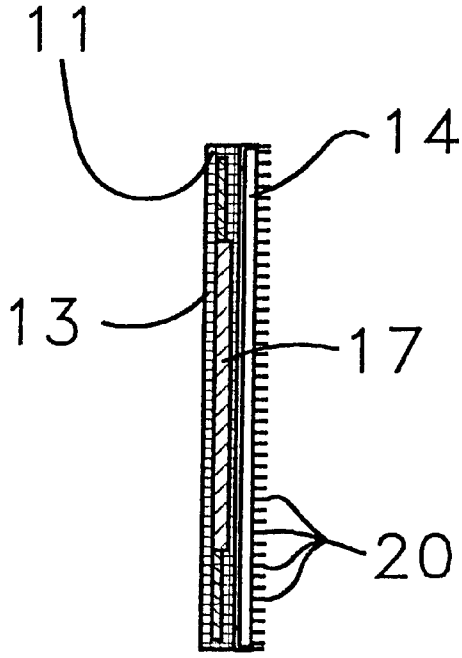
FIG. 4 is another on-edge elevational view of the present invention.

With reference now to the drawings, and in particular to FIGS. 1 through 4 thereof, a new carrying case assembly for magnet-attracting objects embodying the principles and concepts of the present invention and generally designated by the reference numeral 10 will be described.

As best illustrated in FIGS. 1 through 4, the carrying case assembly for magnet-attracting objects 10 generally comprises a carrying case 11 including a spine 12 and pieces of semi-rigid material 13,14 with the spine 12 being centrally-disposed between the pieces of semi-rigid material 13,14. The spine 12 extends a width of the pieces of semi-rigid material 13,14. The pieces of semi-rigid material 13,14 include a first half portion 15 being disposed to one side of the spine 12, and also include a second half portion 16 being disposed to the other side of the spine 12. The first and second half portions 15,16 are foldable upon one another to close the carrying case 11. The pieces of semi-rigid material 13,14 further include an outer piece of semi-rigid material 13 and an inner piece of semi-rigid material 14.

A magnet 17 is conventionally disposed between the pieces of semi-rigid material 13,14. The magnet 17 is a rectangular plate which is disposed in the first half portion 15 of the pieces of semi-rigid material 13,14 between the inner and outer pieces of semi-rigid material 13,14. The magnet 17 is adapted to hold magnet-attracting objects thereto upon the inner piece of the semi-rigid material 14. A pocket 18 is conventionally disposed upon one of the pieces of semi-rigid material 13,14. The pocket 18 is disposed upon the second half portion 16 of the pieces of semi-rigid material 13,14 and upon the inner piece of semi-rigid material 14. The pocket 18 including a piece of material having side and bottom edges which are conventionally attached and sewn to the inner piece of semi-rigid material 14.

A cushion 19 is conventionally disposed upon one of the pieces of semi-rigid material 13,14. The cushion 19 is a pincushion which i.s disposed upon the second half portion 16 of the pieces of semi-rigid material 13,14 and upon the inner piece of semi-rigid material 14 below the pocket 18. A fastening member 20,21 is conventionally attached to the pieces of semi-rigid material 13,14 for closing the carrying case 11. The fastening member 20,21 includes rows of teeth 20 being disposed upon a perimeter of the inner piece of semi-rigid material 14, and also includes a teeth-connecting member 21 being slidably and conventionally disposed upon the rows of teeth 20. The fastening member 20,21 is a zipper.

In use, the user opens the carrying case 11 and places pins and needles inside the carrying case 11 with the magnet 17 attracting and holding onto the pins and needles so that the user does not prick or cut oneself as the user uses the pins and needles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrying case assembly for magnet-attracting objects comprising:

a carrying case including a spine and pieces of semi-rigid material with said spine being centrally-disposed between said pieces of semi-rigid material;

a magnet being disposed next to one of said pieces of semi-rigid material;

a pocket being disposed upon one of said pieces of semi-rigid material;

a pincushion being disposed upon one of said pieces of semi-rigid material, below said pocket; and a fastening member being attached to said pieces of semi-rigid material for closing said carrying case.

2. A carrying case assembly for magnet-attracting objects as described in claim 1, wherein said spine extends a width of said pieces of semi-rigid material.

3. A carrying case assembly for magnet-attracting objects as described in claim 2, wherein said pieces of semi-rigid material includes a first half portion being disposed to one side of said spine, and also includes a second half portion being disposed to the other side of said spine, said first and second half portions being foldable upon one another to close said carrying case.

4. A carrying case assembly for magnet-attracting objects as described in claim 3, wherein said pieces of semi-rigid material further includes an outer piece of semi-rigid material and an inner piece of semi-rigid material.

5. A carrying case assembly for magnet-attracting objects as described in claim 4, wherein said fastening member includes rows of teeth being disposed upon a perimeter of said inner,piece of semi-rigid material, and also includes a teeth-connecting member being slidably disposed upon said rows of teeth.

6. A carrying case assembly for magnet-attracting objects as described in claim 5, wherein said fastening member is a zipper.

7. A carrying case assembly for magnet-attracting objects as described in claim 3, wherein said magnet is a rectangular plate which is disposed in said first half portion of said pieces of semi-rigid material between said inner and outer pieces of semi-rigid material, said magnet being adapted to hold magnet-attracting objects thereto upon said inner piece of said semi-rigid material.

8. A carrying case assembly for magnet-attracting objects as described in claim 3, wherein said pocket is disposed upon said second half portion of said pieces of semi-rigid material and upon said inner piece of semi-rigid material, said pocket including a piece of material having side and bottom edges which are attached to said inner piece of semi-rigid material.

9. A carrying case assembly for magnet-attracting objects comprising:

a carrying case including a spine and pieces of semi-rigid material with said spine being centrally-disposed between said pieces of semi-rigid material, said spine extending a width of the pieces of semi-rigid material, said pieces of semi-rigid material including a first half portion being disposed to one side of said spine, and also including a second half portion being disposed to the other side of said spine, said first and second half portions being foldable upon one another to close said carrying case, said pieces of semi-rigid material further including an outer piece of semi-rigid material and an inner piece of semi-rigid material;

a magnet being disposed between said pieces of semi-rigid material, said magnet being a rectangular plate which is disposed in said first half portion of said pieces of semi-rigid material between said inner and outer pieces of semi-rigid material, said magnet being adapted to hold magnet-attracting objects thereto upon said inner piece of said semi-rigid material;

a pocket being disposed upon one of said pieces of semi-rigid material, said pocket being disposed upon said second half portion of said pieces of semi-rigid material and upon said inner piece of semi-rigid material, said pocket including a piece of material having side and bottom edges which are attached to said inner piece of semi-rigid material;

a cushion being disposed upon one of said pieces of semi-rigid material, said cushion being a pincushion which is disposed upon said second half portion of said pieces of semi-rigid material and upon said inner piece of semi-rigid material below said pocket; and a fastening member being attached to said pieces of semi-rigid material for closing said carrying case, said fastening member including rows of teeth being disposed upon a perimeter of said inner piece of semirigid material, and also including a teeth-connecting member being slidably disposed upon said rows of teeth, said fastening member being a zipper.

* * * * *